US006357093B1

(12) United States Patent
Takahashi

(10) Patent No.: US 6,357,093 B1
(45) Date of Patent: Mar. 19, 2002

(54) SHOELACE FASTENER

(76) Inventor: Yuji Takahashi, 1088-2 Shimoasao, Asao-ku, Kawasaki-shi, Kanagawa-ken 215-0022 (JP)

( * ) Notice: Subject to any disclaimer, the term of this patent is extended or adjusted under 35 U.S.C. 154(b) by 0 days.

(21) Appl. No.: 09/592,330

(22) Filed: Jun. 13, 2000

(30) Foreign Application Priority Data

Jun. 15, 1999 (JP) ..... 11-205140

(51) Int. Cl.[7] ..... A43C 11/00
(52) U.S. Cl. ..... 24/712; 24/712.8; 24/712.1
(58) Field of Search ..... 24/712, 712.1, 24/713.6, 713.2, 713.3, 714.5, 714.8, 712.8; 36/50.1, 52

(56) References Cited

U.S. PATENT DOCUMENTS 345,494 A * 7/1886 Florsheim ..... 24/713.2
889,301 A * 6/1908 Ellis ..... 24/712.8
1,825,029 A * 9/1931 Trüb ..... 24/105
4,125,918 A * 11/1978 Baumann ..... 24/713.3
4,633,548 A * 1/1987 Siskind et al. ..... 24/715.1
5,778,498 A * 7/1998 Laks ..... 24/625

* cited by examiner

*Primary Examiner*—Robert J. Sandy
(74) *Attorney, Agent, or Firm*—Ostrolenk, Faber, Gerb & Soffen, LLP

(57) ABSTRACT

A fastener for preventing undesirable, accidental loosening of a shoelace during use. The fastener includes a holder piece made up of a serrate shank to be inserted through an eyelet of a shoe and an integral flat head adapted for pressure contact with the inner surface of a flap of the shoe. A fastener cap is put into engagement with the serrate shank on the outer surface of the flap for fastening purposes. A washer is interposed between the flap and the fastener cap and provided with the first through hole free passage of the shoelace and the second through hole for free passage of the serrate shank.

15 Claims, 11 Drawing Sheets

SHOELACE FASTENER

FIELD OF THE INVENTION

The present invention relates to a shoelace fastener, and more particularly relates to a fastening device for preventing loosening of a shoelace suited for use on athletic shoes.

BACKGROUND OF THE INVENTION

The size of a shoe is usually designed a little larger than the standard real foot size in the region of the sole in order to provide good fit whilst allowing slight deformation of the foot during use. Such deformation of the foot usually appears in the intermediate section between the transverse arch and the ball of the foot.

Before using a shoe, its shoelace is knotted tightly on the flap by a user so as to fix the shoe onto the foot. Due to repeated deformation of the foot during use, however, the shoelace loosens gradually on the flat of the shoe. As the shoelace loosens, the foot is biased forwards within the shoe and the user's fingers are pressed against the inside of the toe box. This forced contact pains considerably the foot of the user. In addition, the forward bias of the foot within the shoe develops a gap between the heel of the user and the counter of the shoe. This gap allows frequent up and down movement of the foot during use and causes repeated frictional contact of the heel and the inside of the counter. This repeated frictional contact also pains the foot of the user.

In addition to such pain, loosening of the shoelace allows relatively free movement of the foot within the shoe and the user loses reliable control on the shoe.

The pains on the foot and the poor control on the shoe concur to form fatal drawbacks in particular when the shoe is used for athletic purposes or long travels.

SUMMARY OF THE INVENTION

It is thus the prime object of the present invention to prevent loosening of a shoelace during use, thereby removing uncomfortable pain on a user's foot and assuring reliable control on a shoe even during intense athletic movements.

In accordance with the basic concept of the present invention, a shoelace fastener comprises a holder piece, a fastener cap to be combined with the holder piece and a washer to be interposed between the holder piece and the fastener cap. The holder piece is made up of a serrate shank to be inserted through an eyelet of a shoe and an integral flat head adapted for contact with the inner surface of a flap of the shoe. The fastener cap is adapted for engagement with the serrate shank of the holder piece on the outer surface of the flap. The washer is provided with holes for passage of a shoelace and the serrate shank.

DESCRIPTION OF THE PREFERRED EMBODIMENTS

Figure 1:
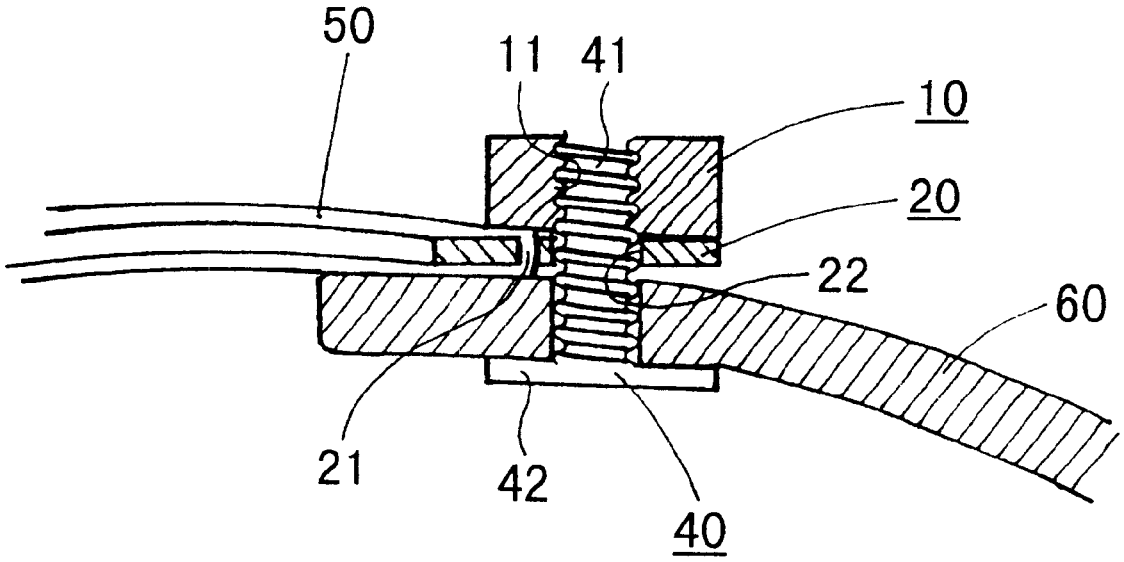
FIG. 1 is a sectional side plan view of the basic embodiment of the shoelace fastener in accordance with the present invention.

The basic embodiment of the shoelace fastener in accordance with the present invention is shown in FIG. 1, in which the shoelace holder includes a holder piece 40, a fastener cap 10 and a washer 20. The serration on the shank is given in the form of a thread and the fastener cap is put into screw engagement with the serrate shank of the holder piece.

More specifically, the holder piece 40 includes a thread shank 41 and a flat head 42 formed integrally with the thread shank 41. The thread shank 41 is adapted for insertion through an eyelet in the flap of a shoe for which the shoelace fastener is used. Whereas, the flat head 42 is adapted for contact with the inner surface of the flap of the shoe.

The fastener cap 10 is provided with an axially through, threaded hole 11 adapted for screw engagement with the thread shank 41 of the holder piece 40.

The washer 20 is given substantially in the form of a flat disc and provided with the first through hole 21 for passage of a shoelace 50 and the second through hole for free passage of the thread shank 41 of the holder piece 40. The first through hole 21 is formed at a position to be covered by the bottom surface of the holder piece 40 when combined for use.

For use, the thread shank 41 of the holder piece 40 is first inserted from downside through an eyelet in the flap of a shoe and the washer 20 is inserted over the thread shank 41. Next, a shoelace 50 is inserted through the first through hoe 21 in the washer 20 and turned back. Finally, the fastener cap 10 is inserted over the thread shank 41 and turned tightly for screw engagement, thereby clamping the shoelace 50 between the bottom surface of the fastener cap 10 and the top surface of the washer 20 as well as between the bottom surface of the washer 20 and the top surface of the flap 60 as illustrated. Such double clamping reliably prevents accidental loosening of the shoelace 50 even during intense athletic movements.

Figure 2:
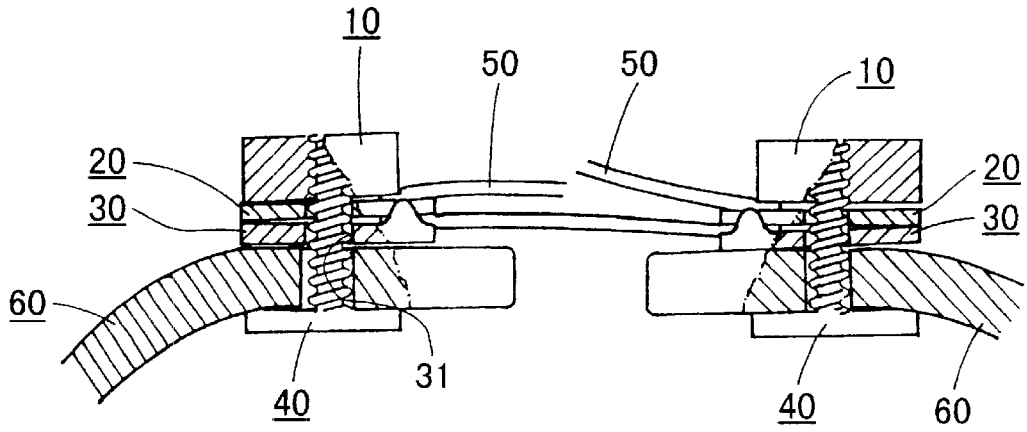
FIG. 2 is a sectional side view of a modified embodiment of the shoelace fastener.

A modified embodiment of the shoelace fastener in accordance with the present invention is shown in FIG. 2, in which the shoelace holder includes a holder piece 40, a fastener cap 10, a washer 20 and a clamp piece 30. The constructions of the holder piece 40, the fastener cap 10 and the washer 20 are same as those shown in FIG. 1. The clamp piece 30 is given substantially in the form of a flat disc and provided with a through hole 31 for free passage of the thread shank 41 of the holder piece 40. In this case, the first through hole 21 for passage of the shoelace 50 is formed at a position not covered by the fastener cap 10 when used.

For use, the shoelace 50 is clamped between the bottom surface of the washer 20 and the top surface of the clamp piece 30.

The shoelace fastener in accordance with the present invention is made of metal, synthetic resin or synthetic rubber. When made of metal, an elastic tube is preferably fitted into the through hole 21 in the washer 20 and the through hole 31 in the clamp piece 30 in order to protect the thread shank 41 against accidental impactive contact with the washer 20 and the clamp piece 30. The contour of the through holes 21 and 31 can be designed freely in accordance with the cross sectional profile of the shoelace for which the shoelace fastener is used.

Figure 3:
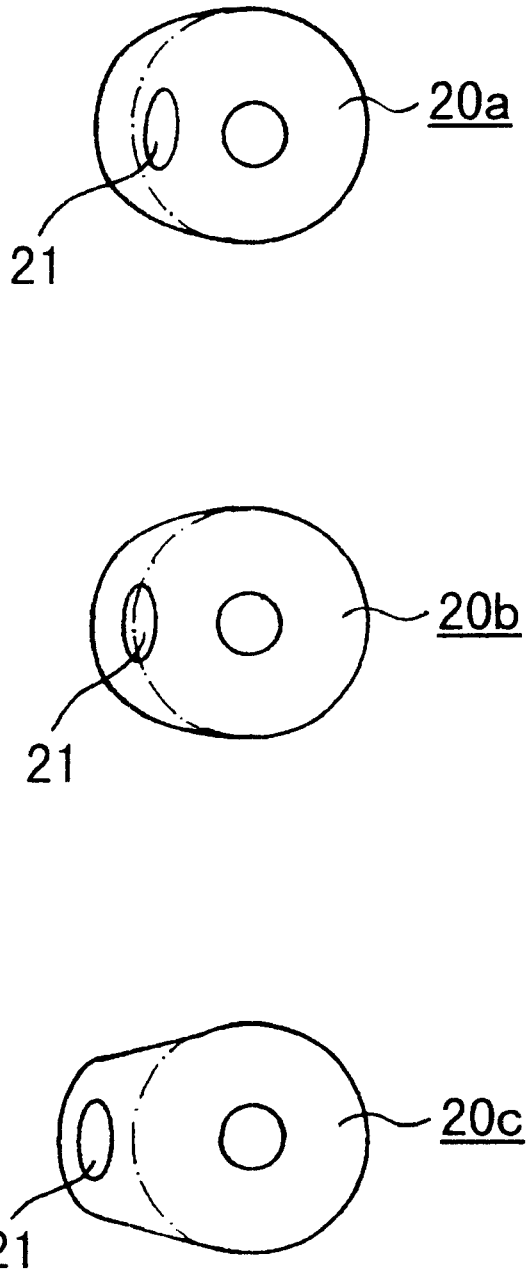
FIG. 3 is top plan views of various embodiments of the washer used for the shoelace fastener.
Figure 4:
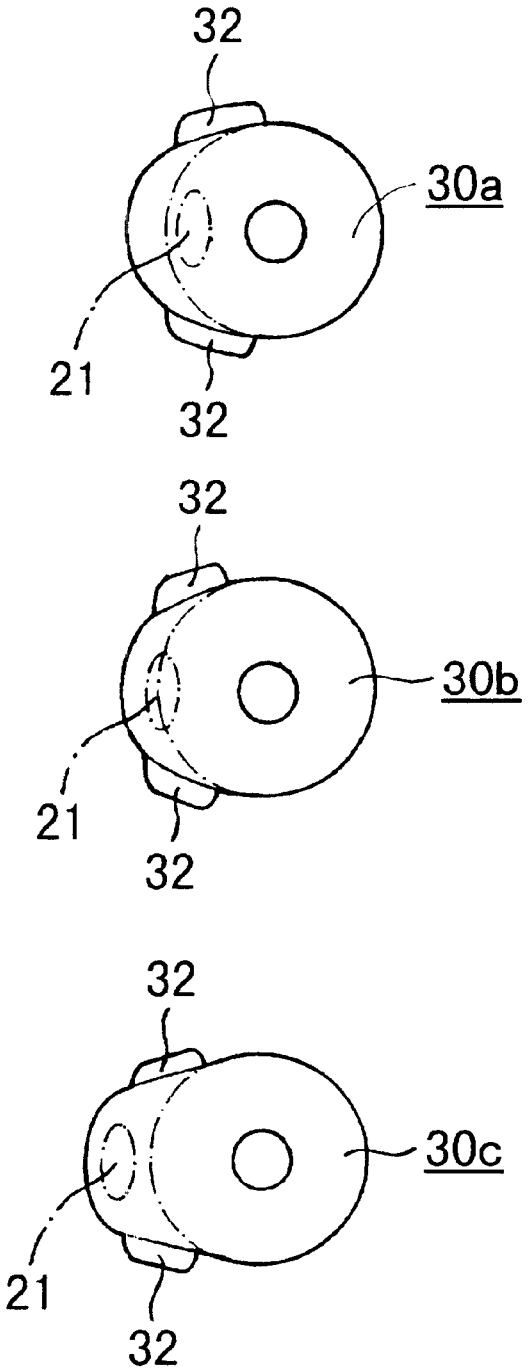
FIG. 4 is top plan views of various embodiments of the clamp piece used for the shoelace fastener.

Some examples of the washer 20 are shown in FIG. 3, whereas some examples of the clamp piece 30 are shown in FIG. 4. In these drawings, the washers and the clamp pieces of the same alphabetic suffix are used in combination. Further, the dashed/dotted lines in the illustration indicates the contour of the fastener cap 10 in the combined position.

In the case of the combination 20*a* with 30*a*, the first through hole 21 for the shoelace 50 is covered by the fastener cap 10. In the case of the combination 20*b* with 30*b*, the through hole 21 is partly covered by the fastener cap 10. In the case of the combination 20*c* with 30*c*, the hole 21 is not covered by the fastener cap 10.

As shown in FIG. 4, the clamp piece 30 is preferably provided with a pair of opposed side bulges 32 which stably embrace the washer 20 when combined.

Figure 5:
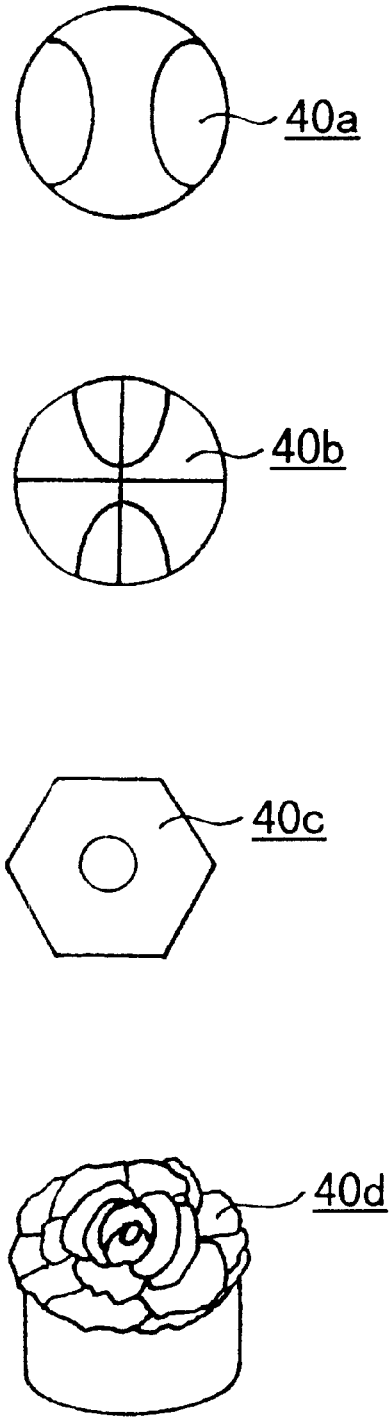
FIG. 5 is top plan views of various embodiments of the holder piece used for the shoelace fastener.

As shown in FIG. 5, various designed can be applied to the top face of the holder piece 40 for ornamental purposes.

Figure 6A:
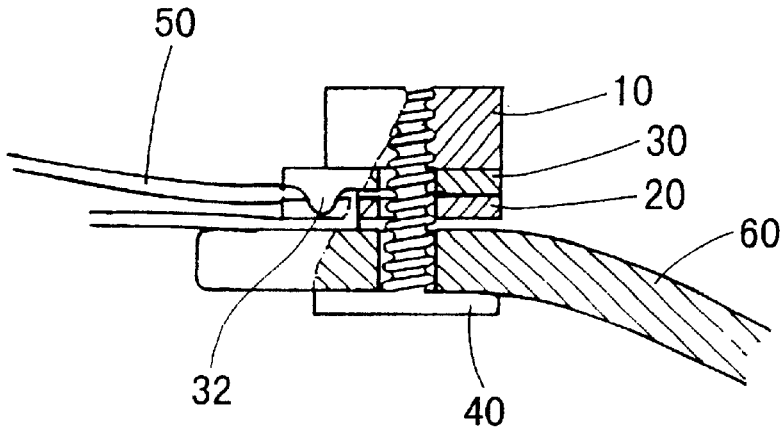
FIGS. 6A and 6B are sectional side plan views of different modes of assemblage of the shoelace fastener.
Figure 6B:
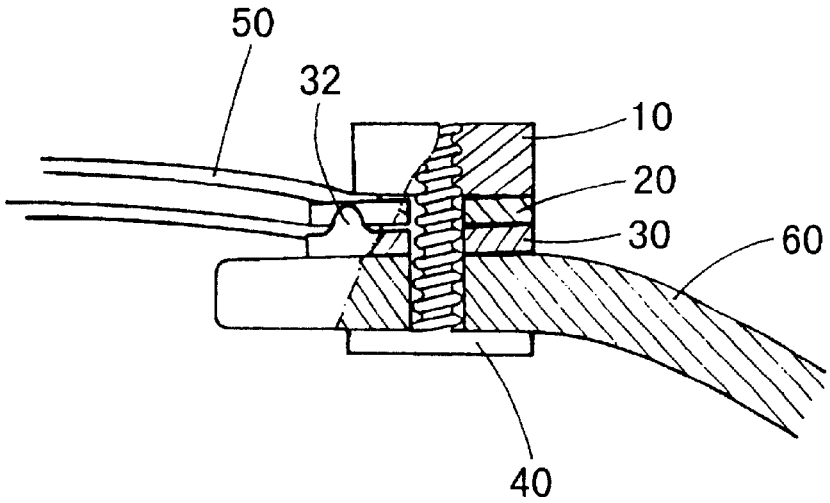

Different modes of assemblage are shown in FIGS. 6A and 6B. In the mode shown in FIG. 6A, the clamp piece 30 is located on the washer 20 and, consequently, the side bulges 32 project downwards. Whereas, in the mode shown in FIG. 6B, the clamp piece 30 is located below the washer 20 and, consequently, the side bulges 32 project upwards. Either assemblage may be employed depending on the condition of real use.

Figure 7A:
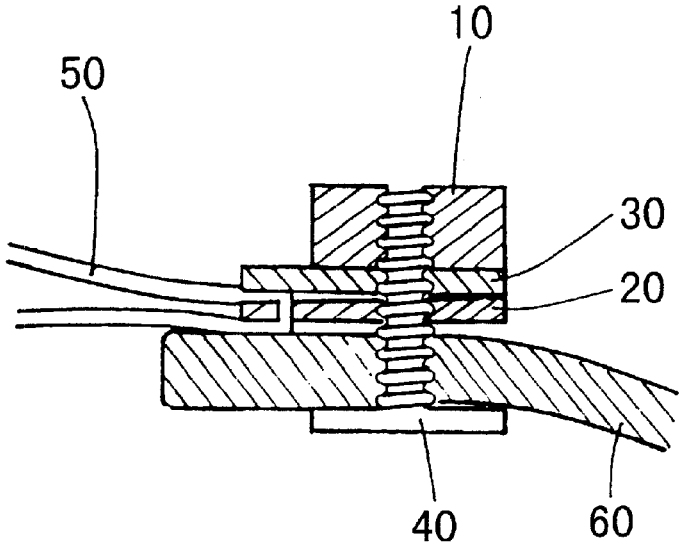
FIGS. 7A and 7B are sectional side plan views of different modes of shoelace clamping.
Figure 7B:
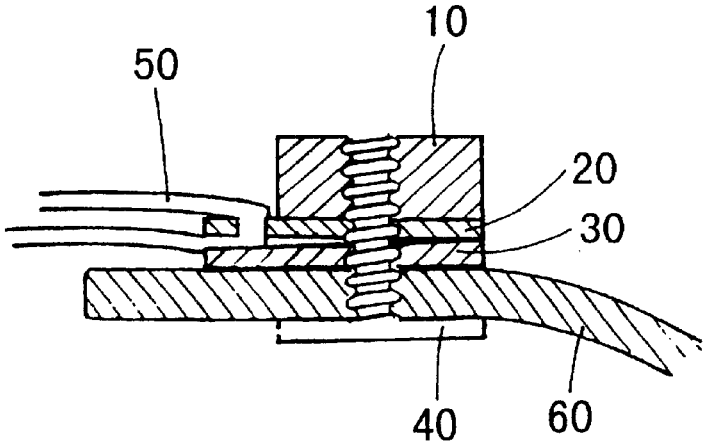

Different modes of passage of the shoelace 50 are shown in FIGS. 7A and 7B. In either case, the shoelace 50 is clamped outside the contour of the fastener cap 10. In the mode shown in FIG. 7A, only the washer 20 is provided with the through hole 21 for the shoelace 50. Whereas, in the mode shown in FIG. 7B, only the clamp piece 30 is provided with the through hole 31 for the shoelace 50. Either mode may be employed depending on the condition of real use.

Figure 8:
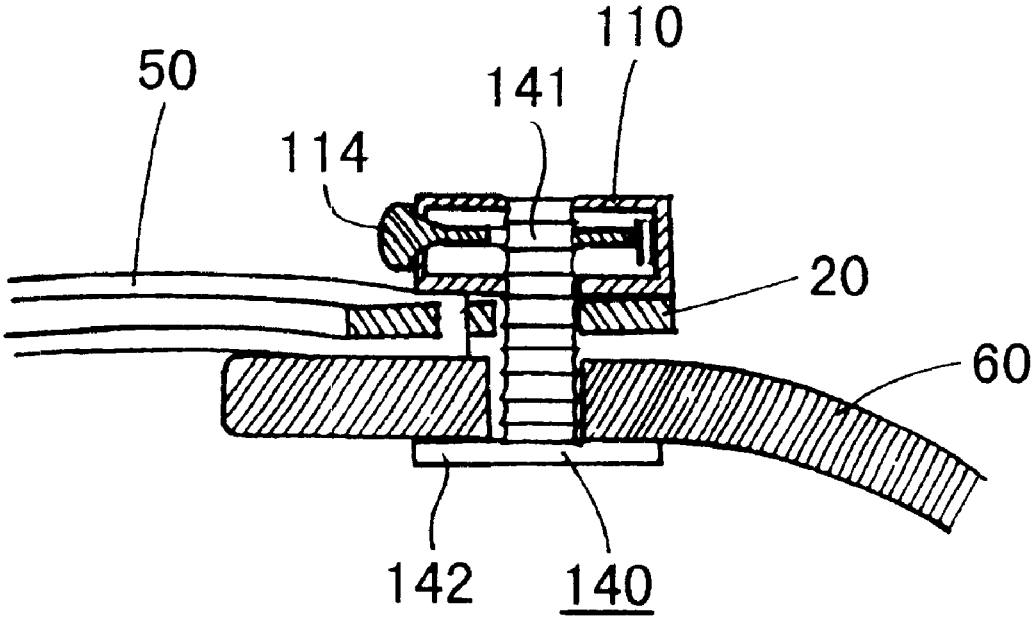
FIG. 8 is a sectional side plan view of a further modified embodiment of the shoelace fastener.
Figure 9A:
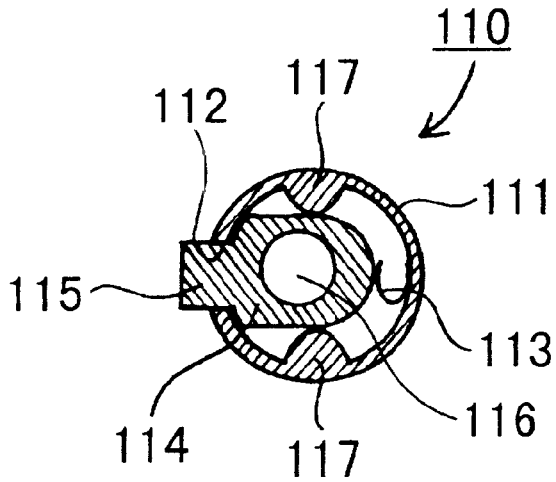
FIGS. 9A and 9B are sectional top plan and perspective plan view of the fastener shown in FIG. 8, FIGS. 10A and 10B are perspective plan views of different modes of fastener attachment.
Figure 9B:
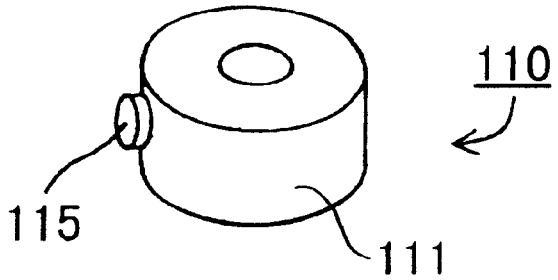

A further embodiment of the shoelace fastener in accordance with the present invention is shown in FIGS. 8, 9A and 9B, in which the serration on the shank is given in the form of one or more annular grooves and the fastener cap is put into hook engagement with the serrate shank of the holder piece. More specifically, fastener cap 110 includes a cylindrical main body 111 closed at both ends and provided with a circumferential slot 112 formed in its side wall. A bent leaf spring 113 is fixed to the inner side wall of the main body 111. A through hole is formed at the center of the bottom for free passage of the serrate shank.

A holder piece 140 is made up of a serrate shank 141 and a flat head 142 formed in one body with the serrate shank 141. The serrate shank 141 is provided with one or more annular grooves.

An elongate hook 114 is provided with an outer knob 115 adapted for manual operation and an inner tip in contact with the leaf spring 113. A joint extends slidably through the slot 112 in the main body 111 whilst connecting the knob 115 to the inner tip. As shown in FIG. 9B, the knob 115 is located outside the main body 111 due to spring repulsion when no manual operation is applied to the hook 114. The hook 114 is further provided with a through hole 116 for free passage of the serrate shank 141 of the holder piece 140. In the position shown in FIG. 9A, i.e. no manual operation is applied to the knob 115, the center of the through hole 116 in the hook 114 is biased outwards from the center of the through hole in the bottom of the main body 111.

For stable movement of the hook 114, a pair of opposite guide bulges 117 are preferably formed on the inner side wall of the main body 111 of the fastener cap 110.

For use, the washer 20 is placed in position on the flap 60 and the holder piece 140 is inserted into the through hole via the eyelet in the flap 60. Next, the knob 115 of the hook 114 is pushed inwards so that the center of the through hole 116 in the hook 114 meets the center of the through hole in the bottom of the main body 111 and the fastener cap 110 is inserted over the serrate shank 141 of the holder piece 140. The manual operation on the knob 115 is removed so that the hook 114 moves outwards due to the spring repulsion. As a consequence circumferential edge of the through hole in the hook 114 engages with one of the annular grooves on the serrate shank 141. As a result, the shoelace 50 is clamped between the bottom surface of the fastener cap 110 and the top surface of the washer 20 as well as between the bottom surface of the washer 20 and the flap 60.

Figure 10A:
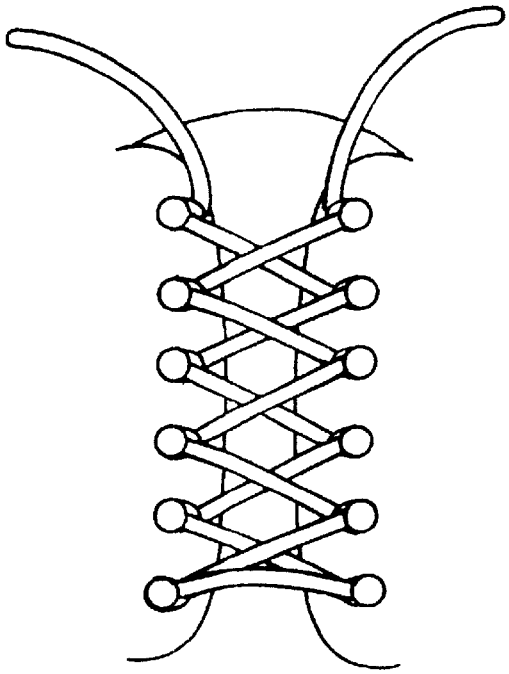
Figure 10B:
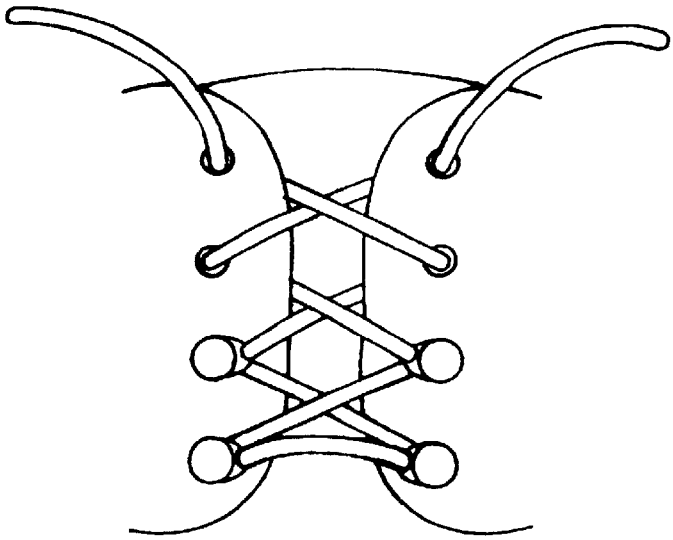

The shoelace fastener in accordance with the present invention may be attached either to all the eyelets in the flap as shown in FIG. 10A or to some selected ones as shown in FIG. 10B.

Figure 11:
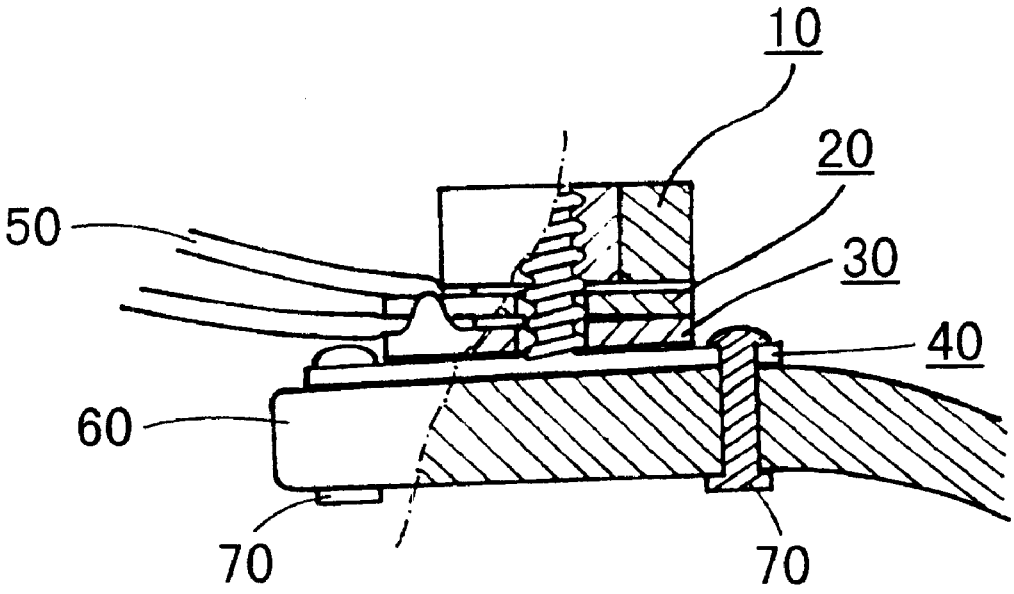
FIG. 11 is a sectional side plan view of a further embodiment of the shoelace fastener in accordance with the present invention.

In a further modified embodiment shown in FIG. 11, the holder piece 40 may be fixed to the flap 60 of the shoe by set bolts 70.

What is claimed is:

1. A shoelace fastener comprising;

a holder piece made up of a serrate shank to be inserted through an eyelet of a shoe and an integral flat head adapted for contact with an inner surface of a flap of said shoe, a fastener cap adapted for engagement with said serrate shank of said holder piece on the outer surface of said flap, and a washer provided with a through hole for passage of a shoelace and said serrate shank and interposed between said flap outer surface and said fastener cap, wherein said serrate shank of said holder piece is provided with one or more annular grooves, said fastener cap includes a cylindrical main body closed at both ends and provided with a circumferential slot, a bent leaf spring fixed to an inner side wall of said main body and a hook provided with an outer knob for manual operation and an inner tip in contact with said leaf spring, said outer knob and said inner tip are connected to each other by a joint extending through said slot.

2. A shoelace fastener as claimed in claim 1 further comprising a clamp piece provided with a through hole for free passage of said serrate shank of said holder piece and superimposed with said washer.

3. A shoelace fastener as claimed in claim 2 in which said serrate shank of said holder piece is provided with a thread, and said fastener cap is adapted for screw engagement with said serrate shank.

4. A shoelace fastener as claimed in claim 3 in which said holder piece is fixed to said flap of said shoe.

5. A shoelace fastener as claimed in claim 3 in which said through hole for said shoelace in said washer is located below said holder piece.

6. A shoelace fastener as claimed in claim 3 in which said through hole for said shoelace in said washer is located below said holder piece.

7. A shoelace fastener as claimed in claim 1 in which said serrate shank of said holder piece is provided with a thread, and said fastener cap is adapted for screw engagement with said serrate shank.

8. A shoelace fastener as claimed in claim 7 in which said holder piece is fixed to said flap of said shoe.

9. A shoelace fastener as claimed in claim 7 in which said through hole for said shoelace in said washer is located below said holder piece.

10. A shoelace fastener as claimed in claim 7 in which said through hole for said shoelace in said washer is located below said holder piece.

11. A shoelace fastener as claimed in claim 1 in which said holder piece is fixed to said flap of said shoe.

12. A shoelace fastener as claimed in claim 1 in which said through hole for said shoelace in said washer is located below said holder piece.

13. A shoelace fastener comprising;

a holder piece made up of a serrate shank to be inserted through an eyelet of a shoe and an integral flat head adapted for contact with an inner surface of a flap of said shoe, a fastener cap adapted for engagement with said serrate shank of said holder piece on the outer surface of said flap, and a washer provided with a through hole for passage of a shoelace and said serrate shank and interposed between a flap outer surface and said fastener cap, a clamp piece provided with a through hole for free passage of said serrate shank of said holder piece and superimposed with said washer, in which said serrate shank of said holder piece is provided with one or more annular grooves, said fastener cap includes a cylindrical main body closed at both ends and provided with a circumferential slot, a bent leaf spring fixed to an inner side wall of said main body and a hook provided with an outer knob for manual operation and an inner tip in contact with said leaf spring, and said outer knob and said inner tip are connected each other by a joint extending through said slot.

14. A shoelace fastener as claimed in claim 13 in which said holder piece is fixed to said flap of said shoe.

15. A shoelace fastener as claimed in claim 13 in which said through hole for said shoelace in said washer is located below said holder piece.

* * * * *